US010792550B2

(12) United States Patent
Cunnane

(10) Patent No.: US 10,792,550 B2
(45) Date of Patent: Oct. 6, 2020

(54) PRACTICE DEVICE

(71) Applicant: Christopher Cunnane, Ottsville, PA (US)

(72) Inventor: Christopher Cunnane, Ottsville, PA (US)

( * ) Notice: Subject to any disclaimer, the term of this patent is extended or adjusted under 35 U.S.C. 154(b) by 0 days.

(21) Appl. No.: 16/351,756

(22) Filed: Mar. 13, 2019

(65) Prior Publication Data

US 2019/0282877 A1 Sep. 19, 2019

Related U.S. Application Data

(60) Provisional application No. 62/642,331, filed on Mar. 13, 2018.

(51) Int. Cl.
*A63B 69/00* (2006.01)
*A63B 102/18* (2015.01)

(52) U.S. Cl.
CPC ..... *A63B 69/0091* (2013.01); *A63B 69/0002* (2013.01); *A63B 2069/0008* (2013.01); *A63B 2102/18* (2015.10); *A63B 2102/182* (2015.10)

(58) Field of Classification Search
CPC ..... A63B 69/0091
USPC ..... 473/429
See application file for complete search history.

(56) References Cited

U.S. PATENT DOCUMENTS 1,529,749 A * 3/1925 Morrison, Jr. ..... A63B 69/3676 473/188
3,229,982 A * 1/1966 Waltenbaugh ..... A63B 69/0091 473/148
3,406,571 A * 10/1968 Hackey ..... A63B 69/0091 473/141
4,105,203 A 8/1978 Cho
4,508,339 A 4/1985 Llewellyn
4,741,536 A * 5/1988 Tai ..... A63B 69/0091 473/149
5,467,979 A * 11/1995 Zarate ..... A63B 69/0091 473/429
5,618,039 A 4/1997 Tsai et al.
5,788,589 A 8/1998 Koo et al.
5,833,555 A * 11/1998 Jer-Min ..... A63B 69/0091 473/429
6,656,063 B2 * 12/2003 Prichard ..... A63B 69/0091 473/139

(Continued)

OTHER PUBLICATIONS

Schutt Swing Trainer, [retrieved Mar. 13, 2019], Retrieved from the Internet: <URL: https://www.schuttsports.com/hit-zone-swing-trainer.html>.

*Primary Examiner* — Laura Davison

(57) ABSTRACT

A practice device includes a base, a support tube, a post, an axle, a first ball rod, and a brake. The support tube extends upward from the base and has a support tube longitudinal axis. The post extends from the support tube and has a first portion and a second portion. The first portion is engaged with the support tube and the second portion includes a first arm. The axle is coupled to the first arm and has a rotation axis. The first ball rod is coupled to a first practice ball and extends between the first practice ball and the axle. The first ball rod is configured to rotate about the rotation axis of the axle and when the first ball rod rotates about the rotation axis of the axle, the first practice ball contacts the brake to slow rotation of the first ball rod.

19 Claims, 13 Drawing Sheets

(56) References Cited

U.S. PATENT DOCUMENTS

| | | | | |
|---|---|---|---|---|
| 9,050,516 | B2 * | 6/2015 | Holland | A63B 69/0075 |
| 2011/0319200 | A1 * | 12/2011 | Ramcharan | A63B 69/0002 473/417 |

* cited by examiner

PRACTICE DEVICE

CROSS-REFERENCE TO RELATED APPLICATIONS

This application claims priority to U.S. Provisional Application No. 62/642,331, filed on Mar. 13, 2018, which is incorporated herein by reference in its entirety.

FIELD

The present invention relates to an aid for practicing the hitting of a ball such as a baseball or softball.

BACKGROUND

Batting tees are known in the art and have been used at various levels for practicing the game of baseball. These prior art devices generally include a tubular member ("tube") mounted on a base platform, which may be shaped like a home plate. The ball is normally supported in a conical opening on the upper end of the tube and positioned within the batter's "strike zone." The tube may be adjustable in length, whereby the height of the ball can be varied to meet the needs of the batter. While these batting tees are popular, they require that the ball be retrieved every time it is hit or when the supply of balls run out. This requires many minutes of practice time being wasted in gathering the balls and resetting them on the tee, especially for inexperienced youth players.

Some adaptations to the standard batting tee are known. Reference is made, for instance, to U.S. Pat. Nos. 5,788,589; 5,618,039; 4,508,339; and 4,105,203; and the SWING TRAINER distributed by Schutt Sports of Litchfield, Ill.

These prior batting aids are expensive and/or have relatively complicated designs, which makes them generally unfit for young Little League players to use and for their coaches to purchase. They are also sometimes relatively heavy and must be rearranged or reconfigured for left and right-handed hitters.

SUMMARY

In one aspect, a practice device includes a base, a support tube, a post, an axle, a first ball rod, and a brake. The support tube extends upward from the base and the support tube has a support tube longitudinal axis. The post extends from the support tube and has a first portion and a second portion. The first portion is engaged with the support tube and the second portion includes a first arm. The axle is coupled to the first arm of the post and has a rotation axis. The first ball rod is coupled a first practice ball and extends between the first practice ball and the axle. The first ball rod is configured to rotate about the rotation axis of the axle and when the first ball rod rotates about the rotation axis of the axle, the first practice ball contacts the brake to slow rotation of the first ball rod.

In another aspect, a practice device includes a base, a support tube, a post, an axle, a coupler, a first ball rod, a second ball rod, and a brake. The support tube extends upward from the base and has a support tube longitudinal axis. The post extends from the support tube. The post has a first arm and a second arm spaced apart from the first arm. The axle is coupled to the first and second arms of the post and has a rotation axis. The coupler is configured to rotate about the rotation axis. The first ball rod extends from a first end to a second end. The first end is coupled to the coupler and the second end is coupled to a first practice ball. The second ball rod extends from a first end to a second end. The first end is coupled to the coupler and the second end is coupled a second practice ball. The first and second ball rods extend in opposite directions from the coupler. Upon striking the first practice ball, the first ball rod and the second ball rod rotate between the first arm and the second arm of the post about the axis of rotation of the axle and as the first ball rod rotates the first practice ball contacts the brake to slow rotation of the first ball rod.

In another aspect, a practice device includes a base, a support tube, a post, an axle, a ball rod, and a brake. The support tube extends upward from the base and has a longitudinal axis. The post extends from the support tube. The axle is coupled to the post and extends transverse to the longitudinal axis of the support tube. The axle having a rotation axis. The ball rod extends from a first end to a second end. The first end is coupled to a first practice ball and the second end is coupled to a second practice ball. When the ball rod rotates about the rotation axis of the axle, the first practice ball and the second practice ball contact the brake to slow rotation of the ball rod.

BRIEF DESCRIPTION OF THE DRAWINGS

These and other features and advantages of the inventions described herein will be more fully disclosed in, or rendered obvious by, the following detailed description of the preferred embodiments, which is to be considered together with the accompanying drawings wherein like numbers refer to like parts and further wherein.

DETAILED DESCRIPTION

Figure 1:
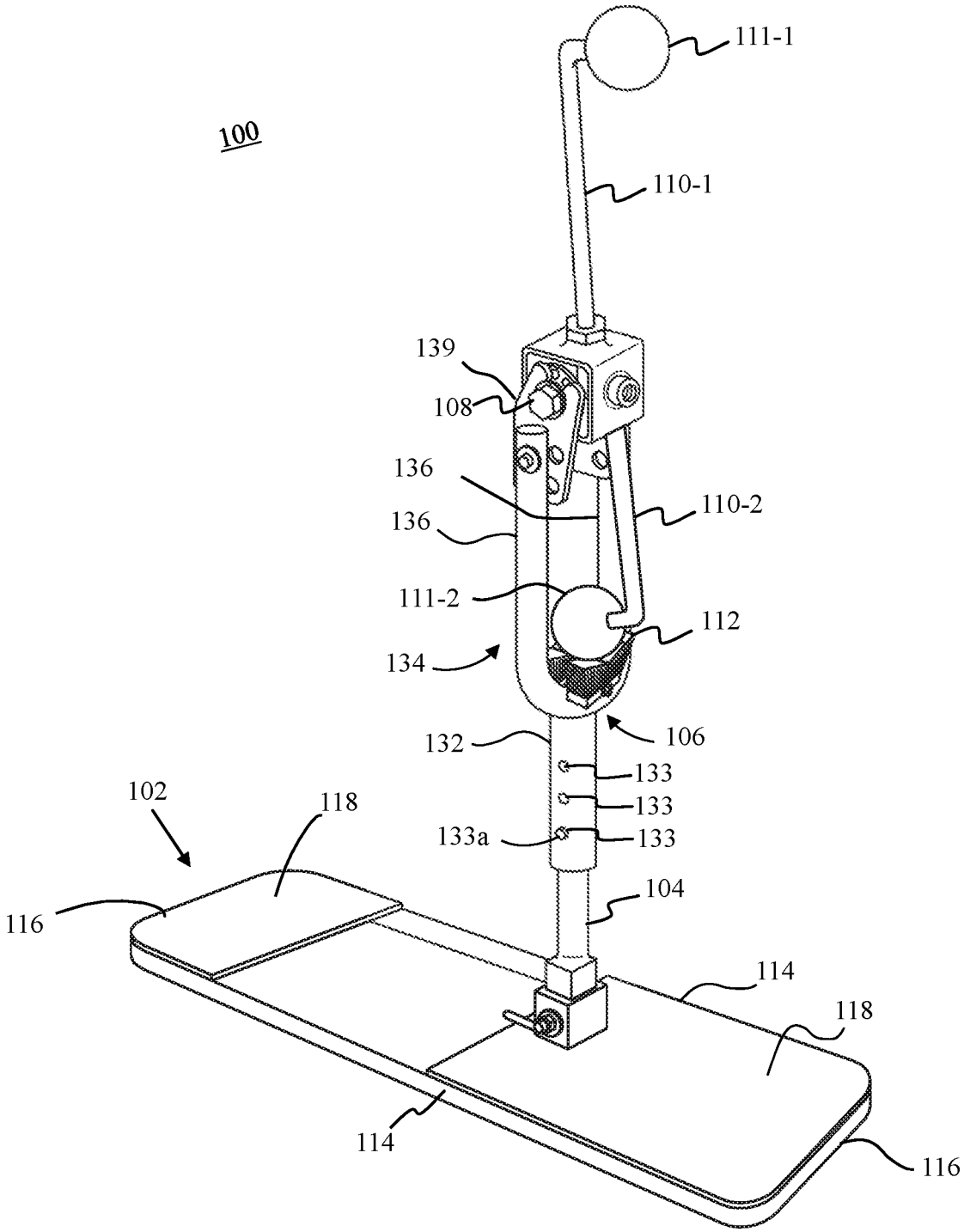
FIG. 1 is a perspective view of a practice device, according to one embodiment described herein.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top," and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "coupled," "connected" and "interconnected," refer to a relationship wherein structures are secured or attached to one another either directly or indirectly through intervening structures, as well as both movable or rigid attachments or relationships, unless expressly described otherwise. The term "operatively or operably connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

The present disclosure describes a batting practice device having practice balls affixed to rotating support arms. When the practice balls are struck, by a baseball or softball bat, the support arms rotate about a rotation axis that is transverse to the support arm extending from the base. The device also includes a brake that slows the rotation of the support arms and eventually stops rotation of the support arms in a position in which one of the practice balls is in the user's "strike zone." This allows the user to quickly practice another swing. Hence, the user is able to make the best use of his or her practice time by practicing his or her swing and not chasing balls.

The devices described herein may improve a baseball player's batting skills by enabling the player to develop their skills by repetitively practicing his or her swing, without interruptions caused by constantly retrieving the balls that have been hit, well or errantly. In various embodiments, the batting practice device can be easily transported and set up for use. In some embodiments, the device can be coupled to the stand of a conventional baseball tee, so as to minimize the amount of equipment needed to be transported.

In various embodiments, the batting practice device can withstand being struck by a baseball bat without being materially damaged. Further, the device may resist being knocked over when struck by a bat. The device can be used by left and right handed hitters without adjustment or even reversing the position of the device.

Although described herein generally as a batting practice device for baseball or softball, the devices described herein may be used to practice a variety of sports including baseball, softball, tennis, squash, or racquetball.

Figure 2:
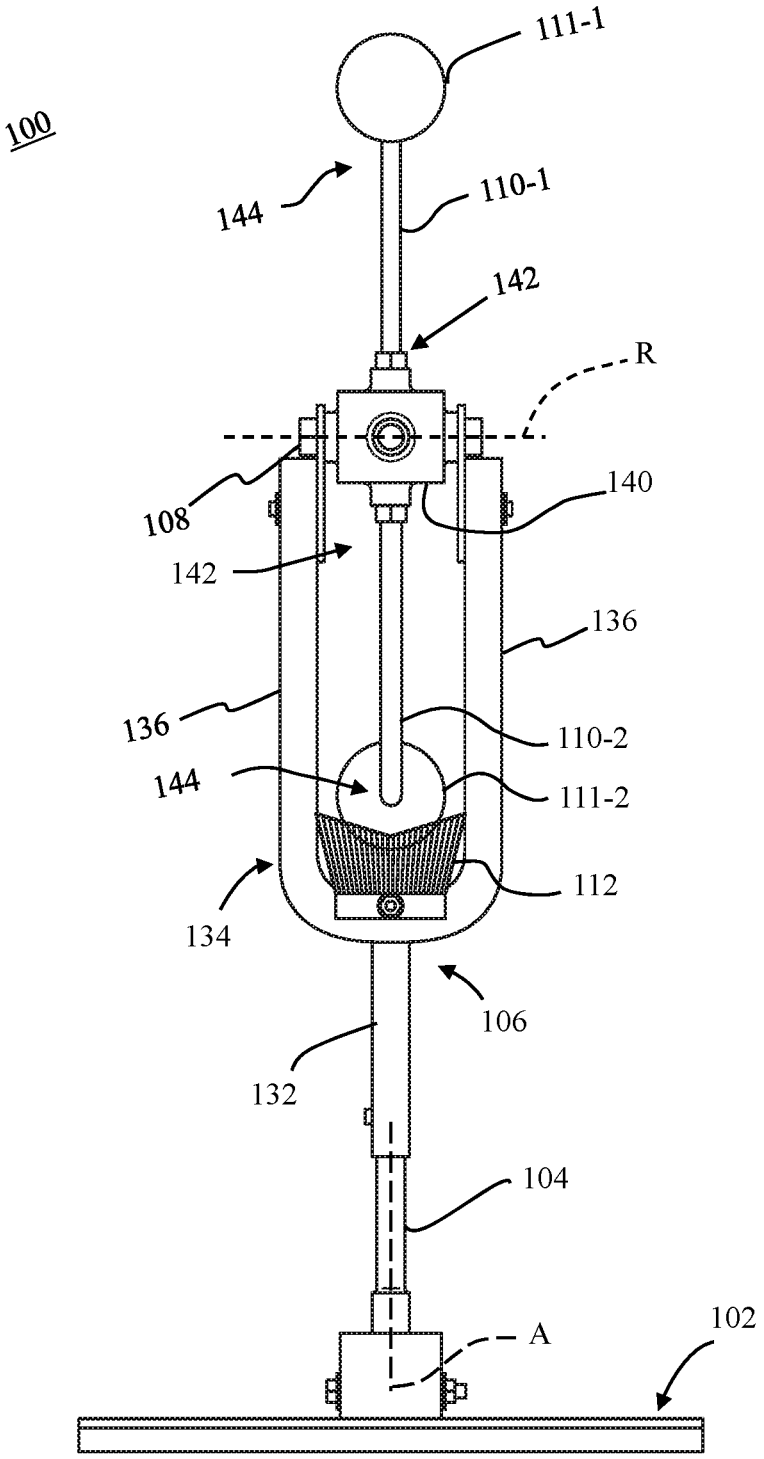
FIG. 2 is a right side view of the practice device of FIG. 1.

As shown in FIGS. 1 and 2, in one embodiment, a batting practice device 100 includes a base 102, a support tube 104, a post 106, an axle 108, one or more ball rods 110, one or more practice balls 111, and a brake 112. The base 102 is configured to rest on the ground and provide a stable platform to support the other portions of the batting practice device 100. In one embodiment, as shown in FIG. 1, the base 102 is in the form of a rectangle having longitudinal sides 114 and transverse sides 116. In such embodiments, the longer, longitudinal sides 114 of the base 102 are aligned with the direction of the user's swing (i.e., extending toward the pitcher's mound). This arrangement provides increased stability during use. The base 102 can be constructed of tubes around the perimeter of the base 102. The tubes can be constructed of steel, cast iron, aluminum, composite material, rubber, or any other appropriate material. In some embodiments, each of the longitudinal sides 114 is at least 17 inches long. As shown in FIG. 1, one or more portions of the base 102 can have a plate 118 on top of the tubes to form closed portions of the base 102. Other portions of the base 102 may not be covered by the plate 118, thereby reducing the weight of the batting practice device 100.

Further, in some embodiments, at least a portion of the base 102 may be configured to retain sand, water, or other material to add additional weight to the base and prevent it from tipping or moving during use. For example, in some embodiments, the base 102 may include a first compartment near the front of the base 102 and a second container near the rear of the base 102, each configured to retain such materials. In other embodiments, the entire base 102 may be configured to retain such materials. Alternatively, the user may apply weights to the top of the base 102.

In another embodiment, the base 102 is in the shape of a square or a home plate and has a thickness of about ⅜ inches to about ¼ inches.

Figure 4:
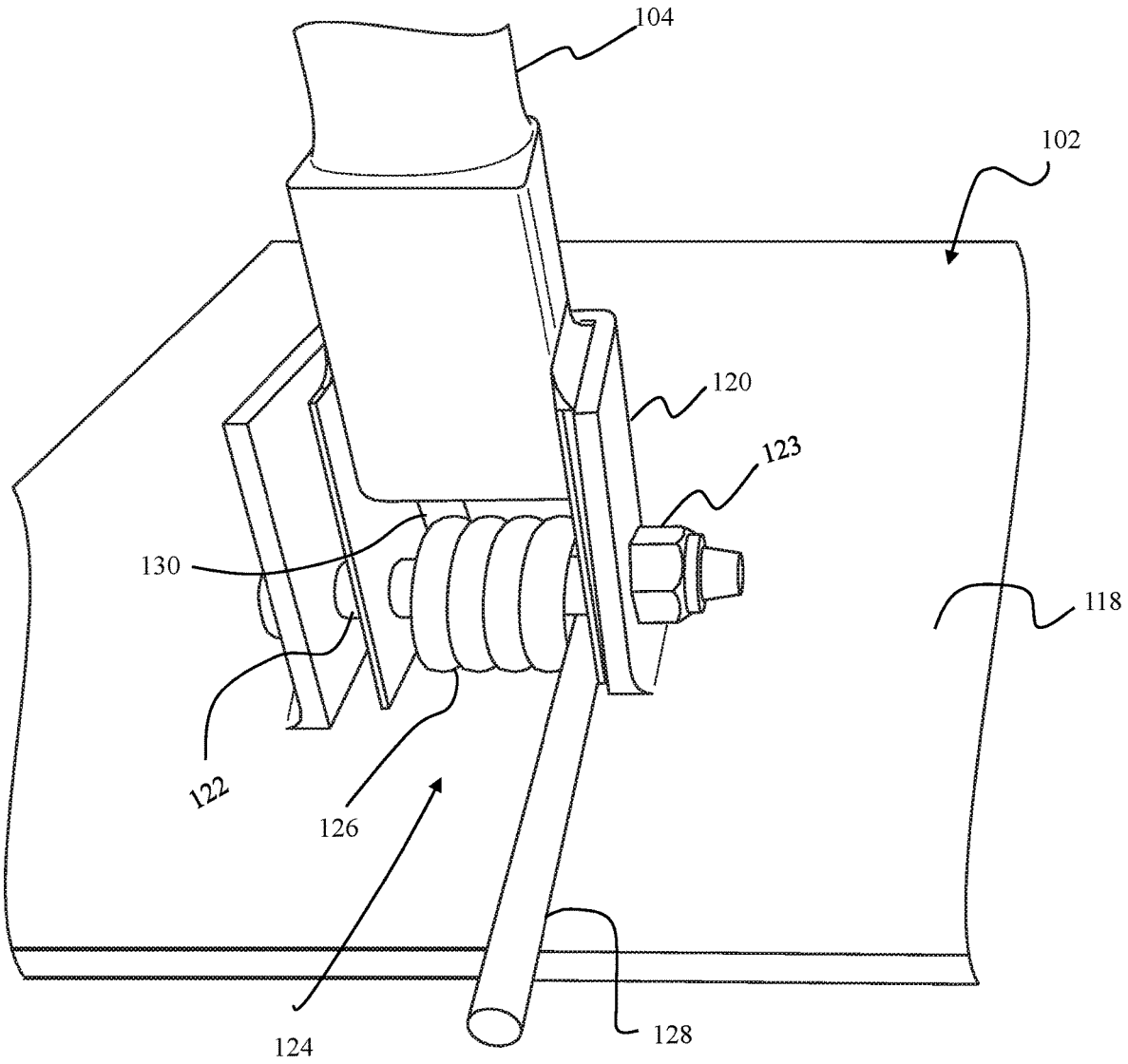
FIG. 4 is a detail view of the coupling of the base and support tube of the practice device of FIG. 1.

The support tube 104 is coupled to, and extends upward from, the base 102. As shown best in FIG. 4, in one embodiment, a bracket 120 is affixed to the plate 118 of the base 102 and the support tube 104 is coupled to the bracket 120. The bracket 120 can be attached to the plate 118 in any appropriate manner. For example, as shown in FIG. 4, the bracket 120 may be welded to the plate 118. In other embodiments, the bracket 120 is coupled to the plate 118 with threaded fasteners, by bonding, or any other appropriate method. In one embodiment, as shown in FIG. 2, the support tube 104 is coupled to the bracket 120 using a fastener 122. For example, the fastener 122 may be a bolt passing through aligned holes in the support tube 104 and the bracket 120. As shown in FIG. 2, the fastener 122 may be secured with a nut 123. In other embodiments, the fastener 122 is in the form of an unthreaded rod and is secured in place with a pin or other appropriate means. The support tube 104 can be constructed from metal (i.e., steel or cast iron), rubber, synthetic rubber, composite material, or any other appropriate material. The support tube 104 defines a longitudinal axis 'A' along its length (shown in FIG. 2).

In addition, in some embodiments, as shown in FIG. 4, the batting practice device 100 further includes a torsion spring 124. The torsion spring 124 is mounted such that the fastener 122 passes through the winding 126 of the torsion spring 124. A first leg 128 of the torsion spring 124 is in contact with the base 102 and a second leg 130 of the torsion spring extends upward into the support tube 104. Hence, in use, the support tube 104 is able to pivot about the fastener 122 with respect to the base 102. The torsion spring 124 resists the pivoting motion of the support tube 104 and returns the support tube 104 to its upright position. This allows the batting practice device 100 to have some flexibility during use such that there is not a jarring force imparted on the user's bat during use.

Returning to FIG. 1, the post 106 extends upward from the support tube 104. The post 106 has a first portion 132 and a second portion 134. In various embodiments, the first portion 132 of the post 106 is telescopically engaged with the support tube 104, and/or frictionally engaged to support different heights for the batting practice device 100 to appropriately fit the height of different users. For example, as shown in FIG. 1, in one embodiment, post 106 includes a plurality of holes 133 spaced along the length of first portion 132. Holes 133 can be selectively engaged by a pin 133*a* of support tube 104 to adjust the height of batting practice device 100. In one embodiment, the height of the batting practice device 100 from the base 102 to the center of a practice ball 111 in a highest vertical position is approximately 30-48 inches. In another embodiment, the height is about 36 inches.

The second portion 134 of the post 106 includes a pair of spaced apart support arms 136, shown best in FIG. 2. In other embodiments, the post 106 has only a single support arm. In at least one embodiment in which post 106 has a single support arm, the single support arm is spaced away from the longitudinal axis 'A'. In one embodiment, the first 132 and second 134 portions are constructed from steel or aluminum and are welded together. In other embodiments, the first 132 and second 134 portions may be integrally formed, such as by injection molding the entire post 106 with polymeric material, either a thermoplastic or thermosetting resinous material. In various embodiments, this resinous material is lightweight and impact resistant. Such materials can include nylon, acrylic, polyethylene, polypropylene and synthetic rubber. The post 106 may also be made of wood or composite materials. In various embodiments, the post 106, including first portion 132 and support arms 136, is hollow so as to minimize the weight of the batting practice device 100. In some embodiments, the first portion 132 of the post 106 is circular. In some such embodiments, first portion 132 has a diameter of about 1 inch. In other embodiments, the first portion 132 of the post 106 has a square, triangle or multi-facet cross-section that engages the support tube 104, to prevent or minimize rotation of the post 106. In various embodiments, the support arms 136 of the post 106 have a diameter of about 1 inch. Further, in one embodiment, the distance between the support arms 136 is about 3.5 inches. In another embodiment, the distance between the support arms 136 is about 4 inches, such that the space can accommodate a softball.

Figure 6:
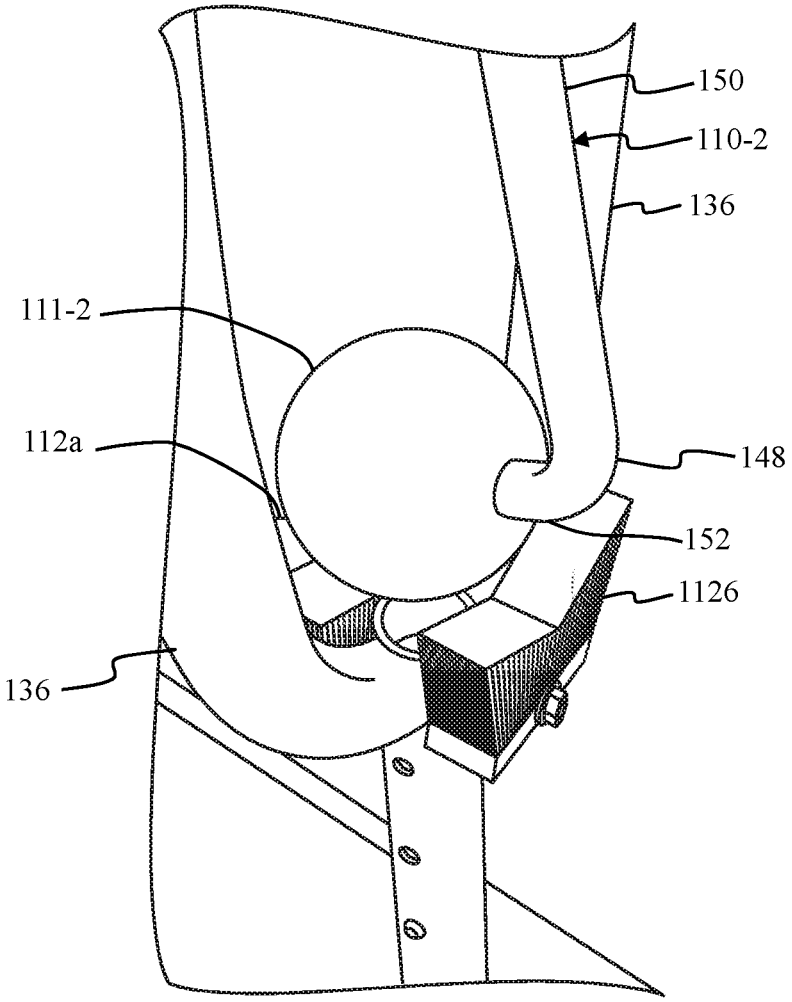
FIG. 6 is a detail view of the brake of the practice device of FIG. 1.
Figure 9:
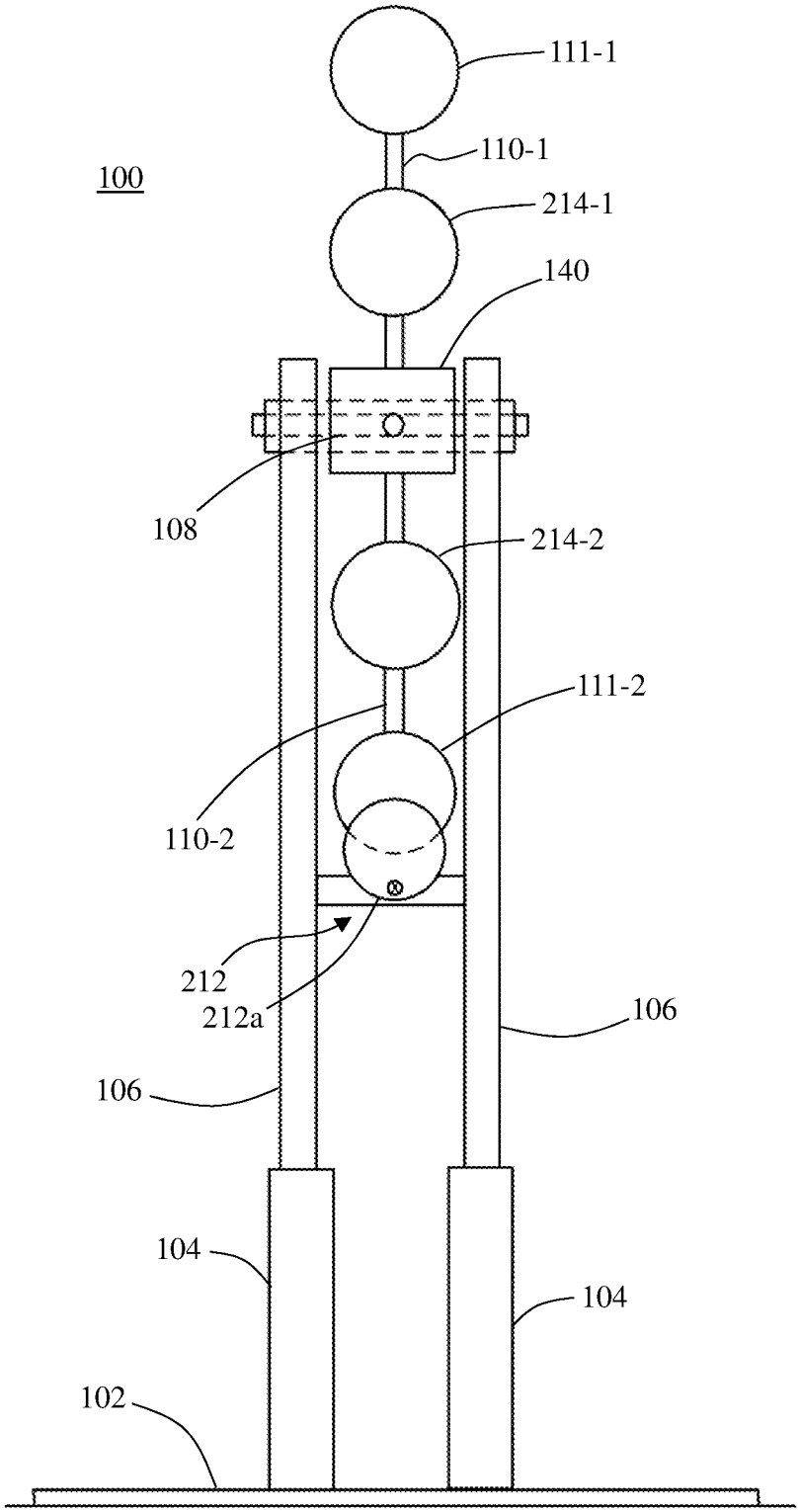
FIG. 9 is a front view of a practice device, according to another embodiment described herein.

In an alternative embodiment, as shown in FIG. 9, practice device 100 includes two support tubes 104 spaced apart from one another and extending from base 102. Practice device 100 further includes two posts 106, one coupled to and extending from a respective support tube 104. In such embodiments, each post 106 may be adjustable with respect to the support tube 104 to adjust the height of axle 108 and, thereby, the position of the practice balls 111. For example, each post 106 may telescope with respect to the respective support tube 104, as described above and shown in FIG. 6. In various embodiments, a torsion spring may be included at the connection between each support tube 104 and the base 102 to allow for pivoting of the support tube 104, as described above and shown in FIG. 4.

As shown in FIG. 9, axle 108 is coupled to, and disposed between, the posts 106 at the end of the posts 106 opposite the support tubes 104. The brake is also supported by one or both the posts 106.

Figure 5:
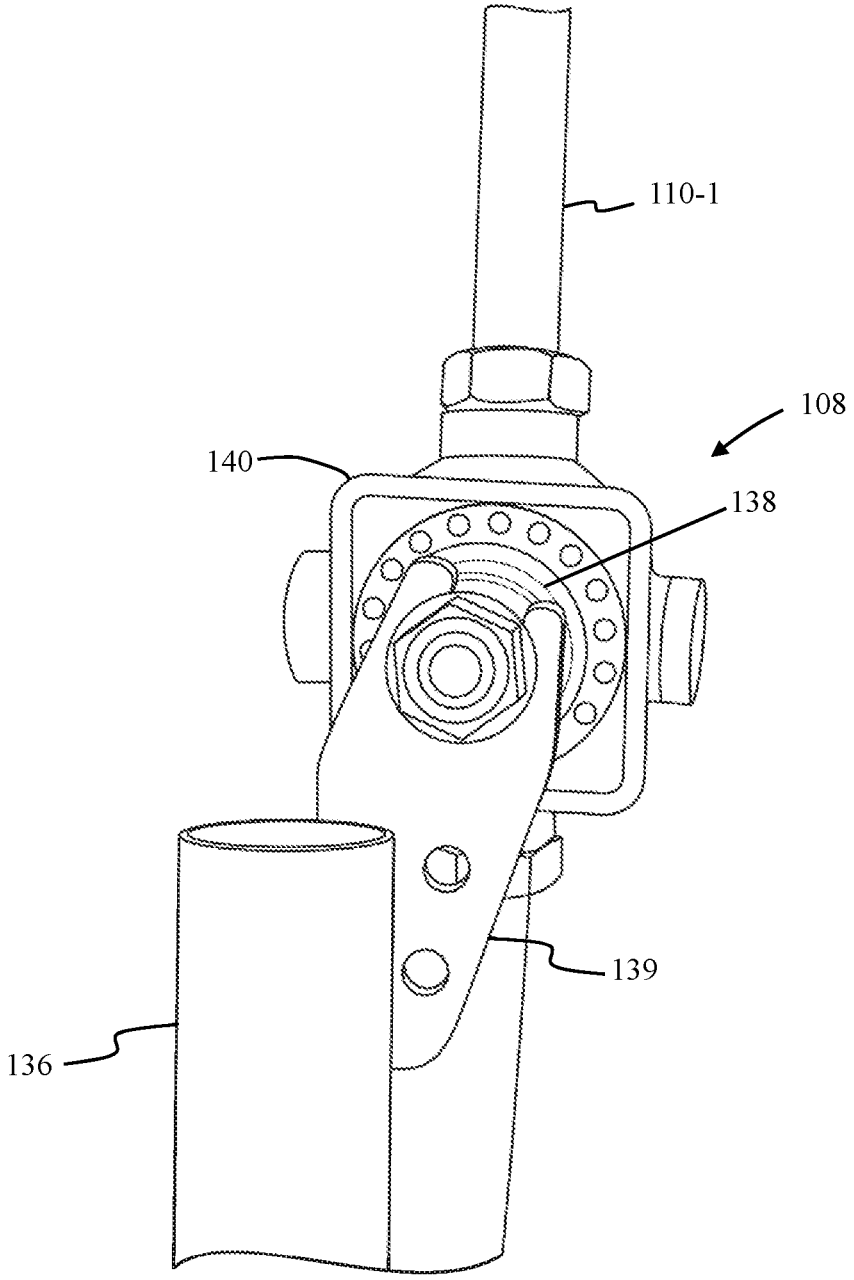
FIG. 5 is a detail view of the axle and coupler of the practice device of FIG. 1.

In various embodiments, as shown in FIG. 5, a bearing 138 may be mounted to axle 108. A coupler 140 is mounted to the outer race of the bearing to allow rotation of the coupler 140 about a rotation axis 'R' of the bearing 138 (shown in FIG. 2). The coupler 140 allows attachment of the one or more ball rods 110, as will be described further herein. In various embodiments, the rotation axis 'R' is oriented transverse to the longitudinal axis 'A' of the support tube 104. In one embodiment, the rotation axis 'R' is oriented parallel to the transverse sides 116 of the base 102. The axle 108 can be mounted to one or both of the support arms 136. For example, as shown in FIG. 5, in one embodiment, the axle 108 is connected to a bracket 139 extending from each support arm 136. The bearing 138 can be any appropriate type of bearing, for example, a ball bearing, a roller bearing, a needle bearing, or a sleeve bearing.

In other embodiments (not shown), in lieu of the bearing 138, the axle 108 may rotate with respect to the support arms 136. In such embodiments, axle 108 can include a protective metal sleeve between the axle and the support arms 136. Alternatively, axle 108 may be mounted within bearings coupled to support arms 136.

As shown in FIG. 2, each of the ball rods 110 have a first end 142 and a second end 144. In one embodiment, the ball rods 110 may have a length of about 6.5 inches as measured from the ball diameter to the rotation axis 'R' of the axle 108. The first end 142 is coupled to coupler 140 and extends therefrom. The ball rods 110 can be coupled to the coupler 140 in any appropriate manner. For example, the ball rod 110 can have threads at the first end 142 configured to engage a threaded bore in coupler 140. In other embodiments, the ball rods 110 are permanently affixed to the coupler 140, for example by welding, press-fit, bonding, or any other appropriate method.

The second end 144 of ball rod 110 is coupled to a practice ball 111. The ball rod 110 and practice ball 111 can be coupled in any appropriate manner. For example, each of the practice balls 111 can have a bore extending into the practice ball 111 and configured to receive a portion of the ball rod 110. The practice ball 111 can be secured to the ball rod 110 by bonding or other means. In one embodiment, the practice balls 111 can be screwed onto the ball rods 110. The practice balls 111 can be permanently or removably coupled to the ball rods 110. In embodiments in which the practice balls 111 are removably coupled, they may be replaced by the user when they are worn.

Figure 3:
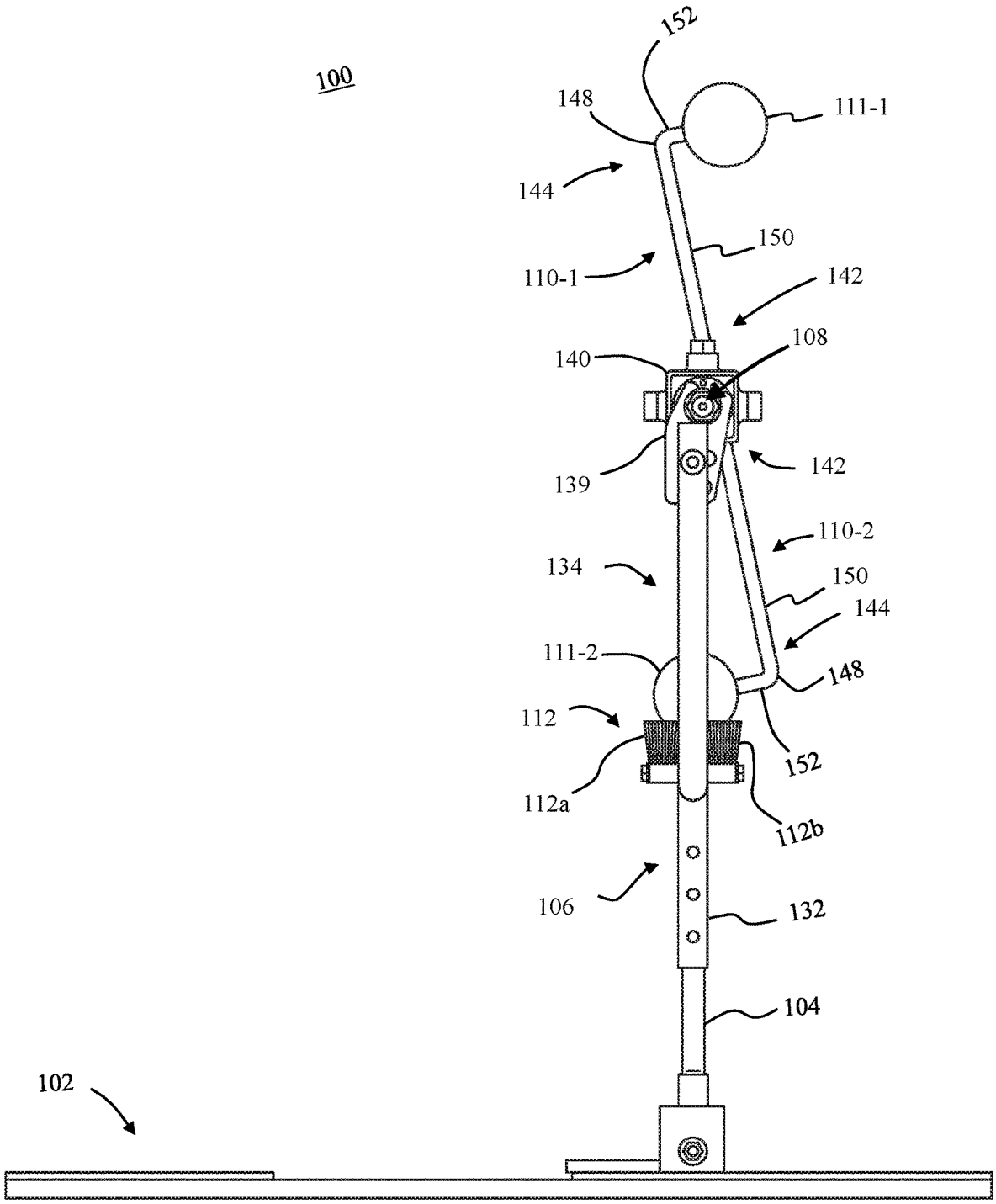
FIG. 3 is a rear view of the practice device of FIG. 1.

In one embodiment, as shown in FIG. 3, the second end 144 of ball rod 110 includes a bend 148 between a main portion 150 and an extension 152 of the ball rod 110. When the practice ball 111 is positioned in the "strike zone" (i.e., the ball rod 110 is in the upward position) the extension 152 extends rearward (i.e., toward the batter's rear foot). Hence, extension 152 presents the practice ball 111 in a more accessible position and reduces the chance that the batter will hit the ball rod 110 and not the practice ball 111 during a swing. Further, presenting the full front face of the practice ball 111 to the user may allow the user to focus on striking particular portions of the ball.

The batting practice device 100 can include any number of ball rods 110 and practice balls 111. For example, in one embodiment, as shown in FIGS. 1-3, the batting practice device 100 includes a first ball rod 110-1 coupled to a first practice ball 111-1 and a second ball rod 110-2 coupled to a second practice ball 111-2. In various embodiments, the second ball rod 110-2 extends from the coupler 140 in the opposite direction of the first ball rod 110-1 and is radially spaced from the first ball rod 110-1. In various embodiments, the second ball rod 110-2 is spaced 180° from the first ball rod 110-1. As such, the main portions 150 of each of the first ball rod 110-1 and the second ball rod 110-2 are substantially collinear.

Figure 7:
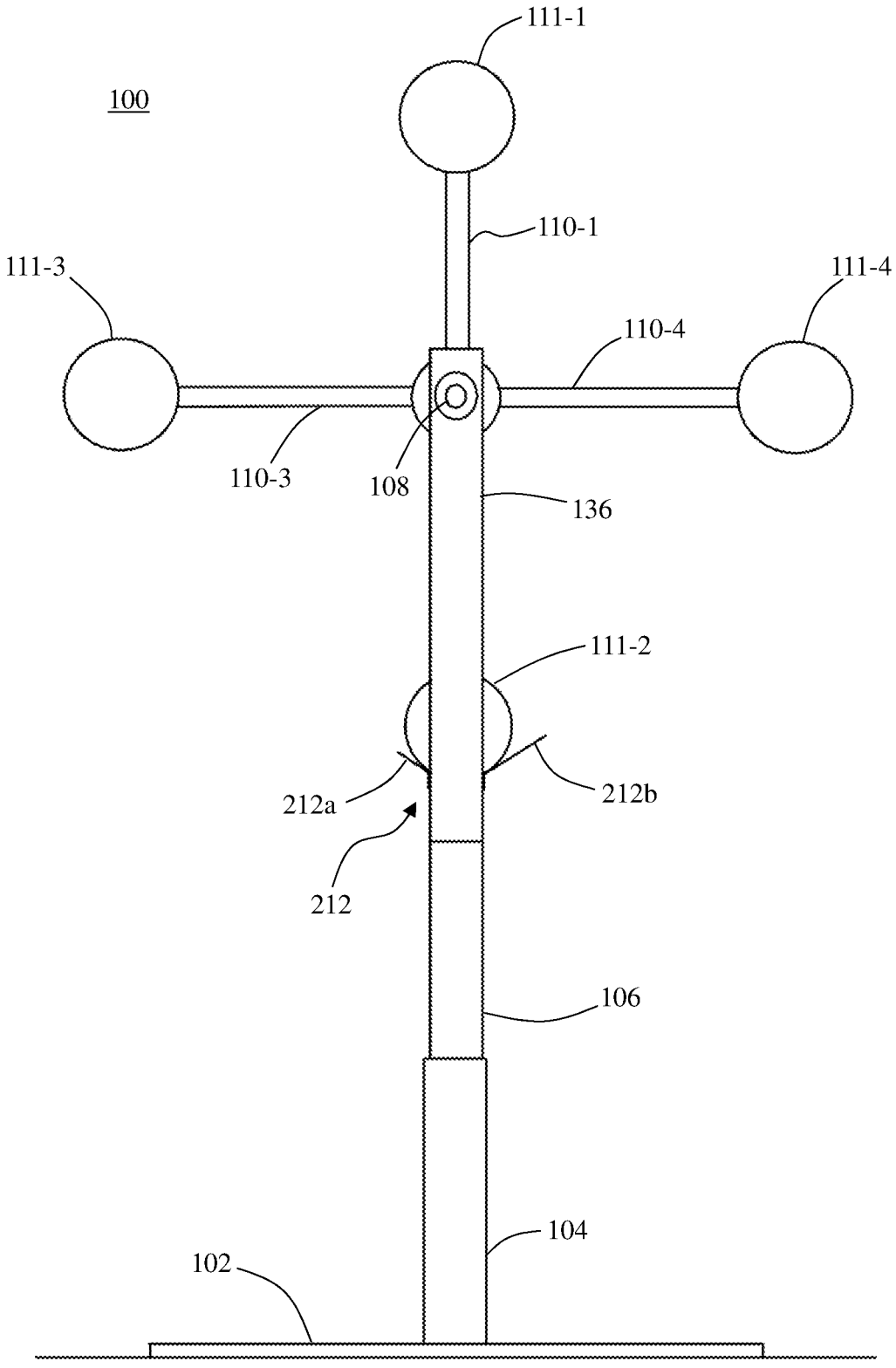
FIG. 7 is a right side view of a practice device, according to another embodiment described herein.
Figure 8:
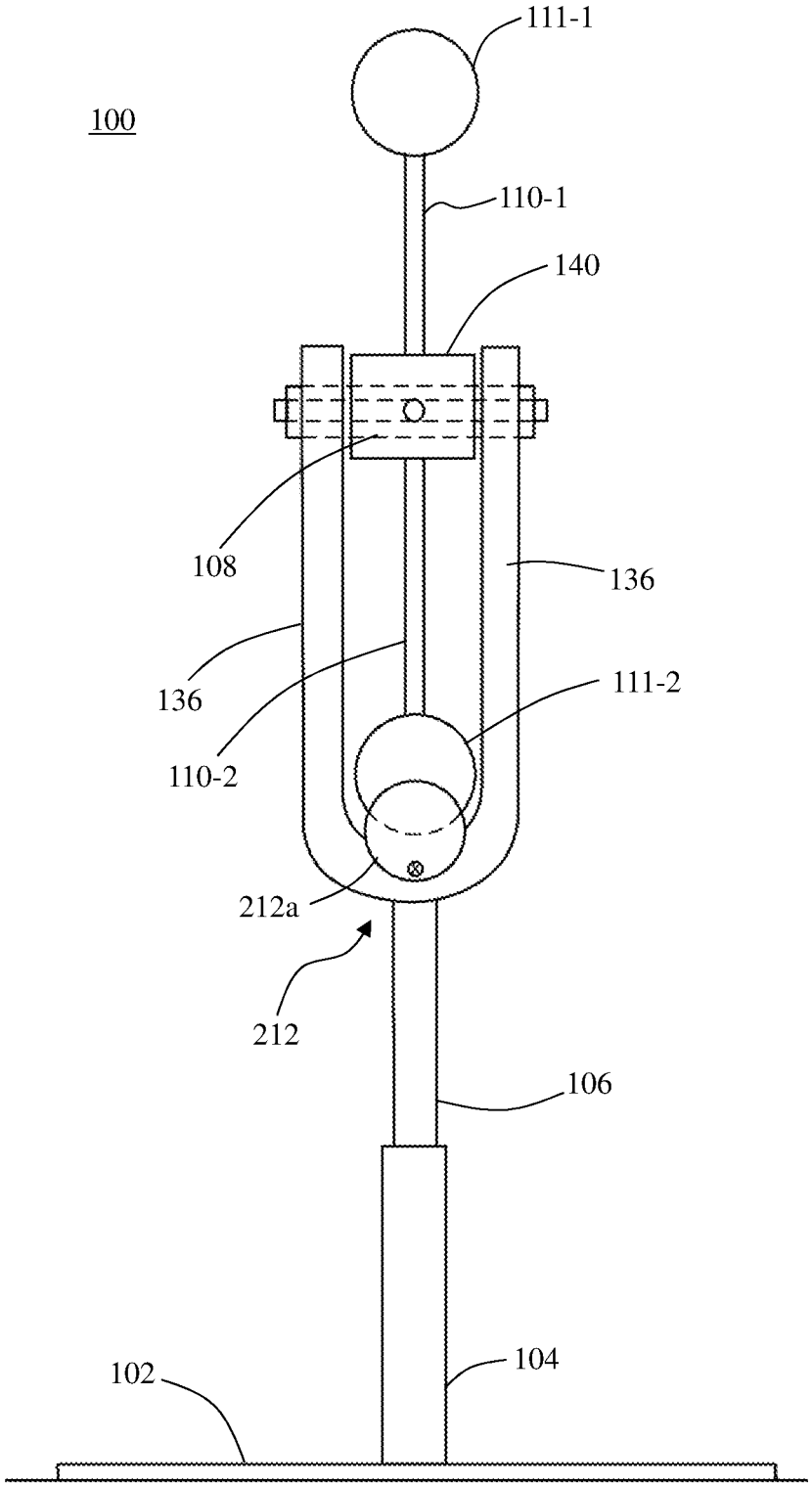
FIG. 8 is a front view of the practice device of FIG. 7.

In various embodiments, the batting practice device 100 also includes a third ball rod 110-3 and third practice ball 111-3 as well as a fourth ball rod 110-4 and practice ball 111-4, as shown in FIGS. 7 and 8. During use, the first, second, third, and fourth practice balls 111*a*-111*d* can be hit randomly by a user as the ball rods 110 and the coupler 140 rotate with the impact of each swing of the user's bat. As will be described in more detail below, the brake 112 causes one of the practice balls 111 to be stopped in the user's "strike zone."

The ball rods 110 can be made of steel, aluminum, plastic, composite, or any other appropriate material. In various embodiments, the practice balls 111 may be a real or plastic practice version of a baseball, tennis ball, racquetball, softball, whiffle ball etc. The balls may include polymeric round spheres, such as whiffle balls or plastic practice baseballs that have one or more openings to make the balls lighter weight. In some embodiments, the balls may be about 3 inches in diameter.

In one embodiment, the ball rods 110 and practice balls 111 are made of impact resistant polymeric material, and can be injection molded together, which can then be screwed into the coupler 140. Alternatively, the ball rods 110, practice balls 111, and coupler 140 can be molded into a single piece of thermoplastic material. In such embodiments, this integrated component can then can be mounted to the axle 108.

In addition, practice device 100 can include features to prevent damage to the user's bat in the event of a misplaced swing. For example, as shown in FIG. 9, in one embodiment, protective balls 214 may be disposed on the ball rods 110 between the practice balls 111 and coupler 140 (e.g., protective ball 214-1 on ball rod 110-1 and protective ball 214-2 on ball rod 110-2). The presence of protective balls 214 prevent the user's bat from contacting the ball rods 110, thereby preventing damage to the bat or the ball rods 110. Protective balls 214 may be the same type of ball as practice balls 111. Alternatively, protective balls 214 may a different size than practice balls 111 (e.g., smaller or larger diameter) or be constructed of a different material than practice balls 111. Protective balls 214 may be secured to the ball rods 110 using any appropriate method. For example, protective balls 214 may be secured to the ball rods 110 using adhesive.

In alternative embodiments, ball rods 110 are at least partially covered in a protective sleeve. The sleeve can be constructed from, for example, an elastomeric material (e.g., neoprene). The protective sleeve may cushion the impact of the bat striking the ball rods 110.

Figure 10A:
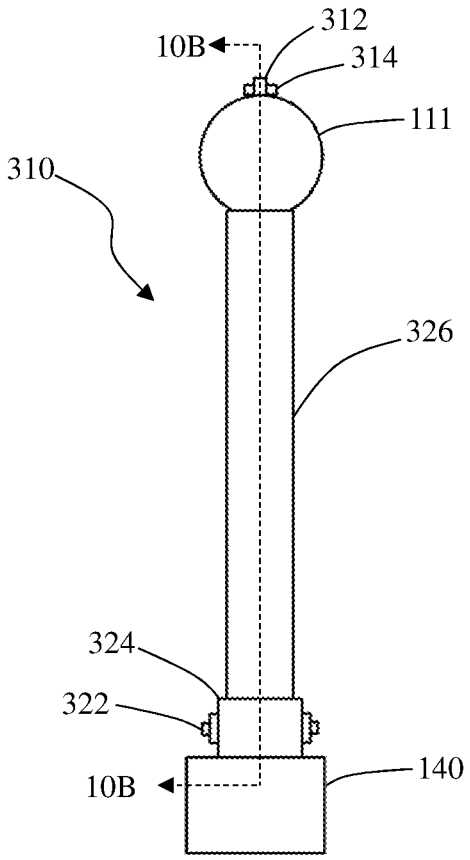
FIG. 10A is a front view of a practice ball connected to a coupler by a ball rod of one embodiment described herein.
Figure 10B:
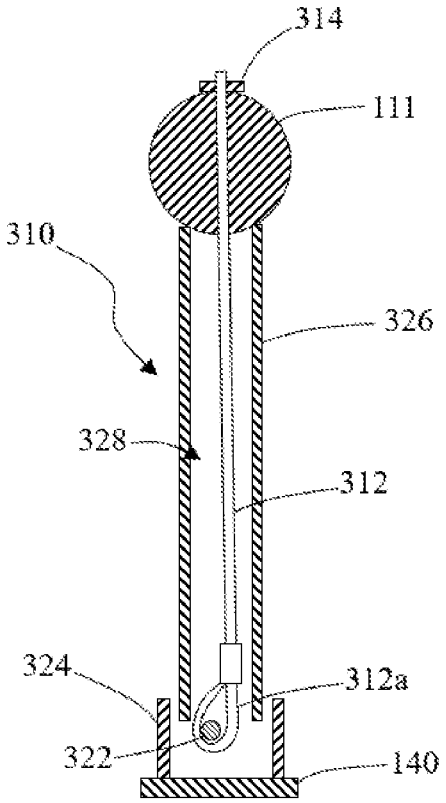
FIG. 10B is a cross-sectional view taken along plane 10B-10B of FIG. 10A.

In other embodiments, in lieu of the relatively rigid ball rods described above, the practice device 100 may include ball rods 310, shown in FIGS. 10A and 10B, that include a tether 312 extending between the practice ball 111 and coupler 140. In one embodiment, tether 312 is constructed of bungee material. In other embodiments, tether 312 is constructed from rope or cord. The tether 312 may be coupled to the practice ball in any appropriate manner. For example, in one embodiment, the tether 312 extends through a bore in the practice ball 111 and is secured on the outside of the practice ball 111 using a retainer 314. The retainer 314 may be, for example, a grommet, a washer, or any other component that is configured to secure the tether 312 and prevent the practice ball 111 from uncoupling from the ball rod 310. In some embodiments (not shown), tether 312 is tied in a knot after passing through the bore in the practice ball 111 to secure the practice ball 111 in place. In other embodiments, the tether 312 is secured within the practice ball 111. For example, the tether 312 may be bonded to the practice ball 111. Alternatively, or additionally, a pin may be inserted through the practice ball 111 such that it extends through a bore formed in the practice ball 111 and the tether 312 may be secured to the pin within the bore.

Figure 11:
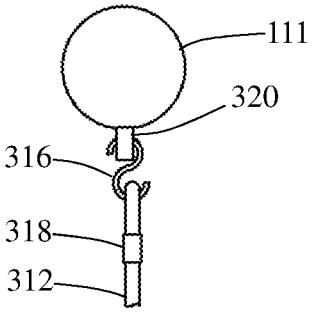
FIG. 11 shows one embodiment of a practice ball coupled to a tether of a ball rod.

In another embodiment, shown in FIG. 11, tether 312 is coupled to practice ball 111 via a hook 316, such as an S-hook. For example, tether 312 may include a loop secured by a ferrule 318, the loop engaging one end of the hook 316. The other end of the hook 316 may be engaged with a tab 320 coupled to the practice ball 111.

The tether 312 may be attached to the coupler 140 in any appropriate manner. For example, in one embodiment, shown in FIG. 10B, tether 312 includes a loop 312*a* (e.g., formed using a ferrule). A pin 322 may be inserted through the loop 312*a* and coupled to a boss 324 of the coupler 140.

Alternatively, the tether may pass through a hole in the coupler 140 and be secured using a cord lock on the inside of the coupler 140. In such an embodiment, the tension in the tether 312 may be adjusted by the user.

Figure 12:
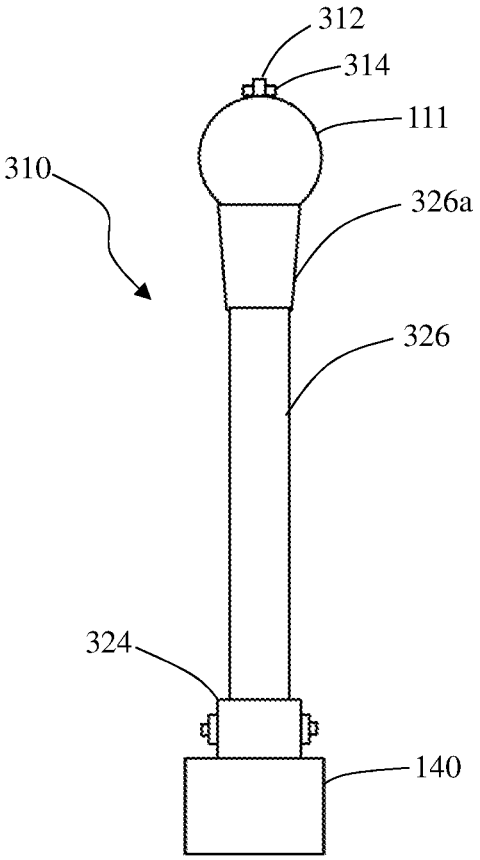
FIG. 12 is a front view of a practice ball connected to a coupler by a ball rod of one embodiment described herein.

The ball rod 310 further includes a sleeve 326 disposed around the tether 312. The tether 312 is disposed within the inner bore 328 of the sleeve 326. The sleeve 326 may include a cup at the end opposite the coupler 140. The cup may be shaped similar to the top ends of typical batting tees such that, in use, when the ball rod 310 is in the upward vertical position the practice ball 111 sits in the cup. For example, the sleeve 326 may include a cone-shaped end 326*a*, as shown in FIG. 12, to better retain the practice ball. The sleeve 326 may be constructed of, for example, an elastomeric material. Hence, if the user strikes the ball rod 310 during use, no damage will be done to the user's bat and no jarring impact will be imparted to the user.

In use, when the practice ball 111 is struck by the user, the tether 312 retains the practice ball 111. In embodiments in which tether 312 is constructed of an extensible material, such as bungee, the practice ball 111 may temporarily extend from the sleeve 326. The elastic properties of the tether 312 then returns the practice ball 111 to the end of the sleeve 326. In various embodiments, the ball rod 310 may further include a spring, such as an extension spring, to increase the restorative force on the practice ball 111, whether the tether 312 is extensible or inextensible.

Figure 13:
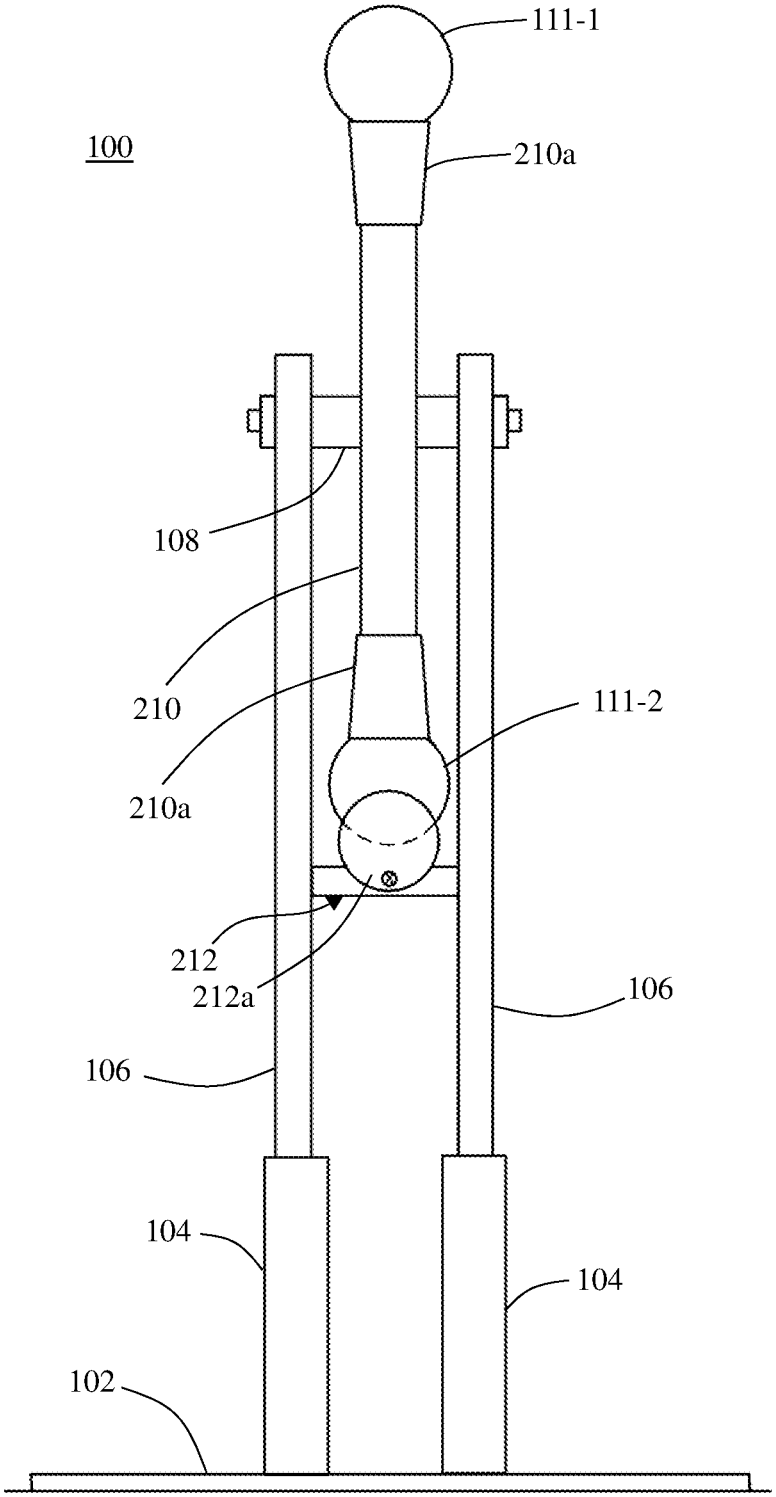
FIG. 13 is a front view of a practice device, according to another embodiment.

In another embodiment, shown in FIG. 13, practice device 100 includes a single ball rod 210 extending between, and coupled to, both first practice ball 111-1 and second practice ball 111-2. The ball rod 210 may be coupled to the practice balls 111 in any manner described herein. For example, in one embodiment, a tether extends between and is coupled to both first practice ball 111-1 and second practice ball 111-2. In other embodiments, separate tethers are provided, each being coupled to one of the practice balls 111. The ball rod 210 may further include a sleeve encompasses the tether, as described above with reference to FIGS. 10A-10B. The ball rod 210 may further include cone-shaped ends 210*a* as described above with reference to FIG. 12.

Ball rod 210 is configured to rotate around axle 108. In various embodiments, the ball rod 210 includes a through-hole within which axle 108 is disposed. Further, a bushing may be disposed in the through-hole such that the bushing is in contact with the axle to provide a wear-resistant surface for sliding contact with the axle 108. Alternatively, a bearing may disposed within the through-hole to allow for rotation of the ball rod 210 around the axle 108. Any appropriate type of bearing may be used, such as, for example, a ball bearing, a roller bearing, a needle bearing, or a sleeve bearing.

Alternatively, the axle 108 and ball rod 210 may rotate together, with axle 108 rotating with respect to posts 106. For example, the axle 108 may be mounted to the posts using a bearing or busing such that the axle 108 may rotate with respect to the posts 106. In such an embodiment, the axle 108 and ball rod 210 may be coupled such that relative rotation between these components is restricted. For example, the axle 108 and ball rod 210 may be keyed together. Alternatively, or additionally, axle 108 may be press-fit or bonded to ball rod 210.

The brake 112 is configured to slow rotation of the ball rods 110 and coupler 140 and stop one of the practice balls 111 in the user's strike zone. For example, in one embodiment, the brake 112 is mounted at the bottom of the second portion 134 of the post 106. In various embodiments, as shown in FIGS. 1-6, the brake 112 includes a forward brake 112*a* mounted on a front side of the post 106 and a rear brake 112*b* on the rear side of the post 106. As the ball rods 110 and practice balls 111 rotate, the practice balls 111 contact the forward 112*a* and rear 112*b* brake. After the rotation is slowed, the ball rods 110 and practice balls 111 come to rest with one of the practice balls 111 against the first 112*a* or second 112*b* brake. For example, in the embodiment shown in FIG. 3, the second practice ball 111-2 has come to rest against the second brake 112*b*. In this position, first practice ball 111*a* is positioned in the user's "strike zone."

As shown in FIG. 2, in one embodiment the brakes 112*a*, 112*b* consist of a plurality of bristles. In various embodiments, the bristles may be of varying lengths. For example, the bristles at the center of the respective brake may be shorter than those nearer the edge of the respective brake. Further, in some embodiments the bristles may have varying material properties such that some bristles are stiffer than others. For example, in some embodiments, the bristles of the forward brake 112*a* are stiffer than the bristles of the rear brake 112*b*. In another embodiment, the bristles of the rear brake 112*b* are stiffer than the bristles of the forward brake 112*a*.

In some embodiments, the forward brake 112*a* may be smaller (or less stiff) than the rear brake 112*b* such that the practice ball is preferably captured between the forward brake 112*a* and the rear brake 112*b*, as shown in FIG. 3.

In other embodiments, the brake takes on other forms. For example, as shown in FIGS. 7 and 8, a brake 212 can include a forward brake 212*a* and a rear brake 212*b* that include pivoting or flexible fingers. In such an embodiment, the brake 212 may provide a series of clicking sounds as the practice balls 111 rotate through the brake 212. In various embodiments, the fingers of forward brake 212*a* and rear brake 212*b* are flexible plastic, which can flex or bend when contacted by a traveling ball, while also slowing down its speed of rotation. In various embodiments, the fingers are disposed at an oblique angle to the longitudinal axis 'A' and are secured to the post 106 with fasteners (e.g., into the first portion 132 of the post 106 or the support arms 136).

Although two brakes are shown, in other embodiments, the brake 112 includes only one brake. Further, in other embodiments (not shown), the brake 112 is positioned such that the brake 112 contacts the ball rods 110 in addition to, or instead of, the practice balls 111.

In various embodiments, the weight of the balls 111, ball rods 110, and the support arms 136 of the post 106 weigh no more than the weight of the base 102 and the support tube 104. In some embodiments, balls 111, ball rods 110, and the support arms 136 of the post 106 weigh about 20-80% of the weight of the base 102 and support tube 104. The lighter weight of the upper portions of the batting practice device 100 may help to avoid the batting practice device 100 from tipping over when contacted by a bat.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention. All patents and published patent applications identified herein are incorporated herein by reference in their entireties.

I claim:

1. A practice device comprising a base;

a support tube extending upward from the base, the support tube having a support tube longitudinal axis;

a post extending from the support tube, the post having a first portion and a second portion, the first portion engaged with the support tube and the second portion including a first arm;

an axle coupled to the first arm of the post, the axle having a rotation axis;

at least two practice balls;

at least two ball rods, wherein each of the ball rods is coupled to a respective one of the practice balls and extends between the respective practice ball and the axle; and a brake positioned along the support tube longitudinal axis and disposed below the axle;

wherein, the ball rods are configured to rotate about the rotation axis of the axle and wherein when the ball rods rotate about the rotation axis, the practice balls contact the brake to slow the rotation of the ball rods such that the ball rods come to rest with one of the practice balls in contact with the brake and another of the practice balls in a hitting position above the axle.

2. The practice device of claim 1, wherein each of the ball rods includes a main portion and an extension, the extension transverse to the main portion and the respective practice ball being coupled to the extension.

3. The practice device of claim 2 wherein each practice ball includes a bore and the extension of one of the ball rods is disposed at least partially within the bore of each practice ball.

4. The practice device of claim 1, further comprising a coupler configured for rotation about the axle, wherein a first end of each ball rod is attached to the coupler.

5. The practice device of claim 4, wherein the at least two ball rods includes a first ball rod and second ball rod, each extending from the coupler, the second ball rod extending in an opposite direction from the first ball rod.

6. The practice device of claim 5, wherein the at least two ball rods further include:

a third ball rod extending from the coupler and radially spaced from the first and second ball rods; and a fourth ball rod extending from the coupler and radially spaced from the first and second ball rods.

7. The practice device of claim 1, wherein the brake comprises:

a first brake; and a second brake;

wherein the first brake and the second brake are configured to retain one of the practice balls when the ball rods are at rest so as to present another one of the practice balls in a user's strike zone.

8. The practice device of claim 7, wherein the first brake and the second brake each include a plurality of flexible bristles.

9. The practice device of claim 1, further comprising a torsion spring coupling the support tube to the base such that the support tube may pivot with respect to the base about a pivot axis that is parallel to the axle.

10. The practice device of claim 9, wherein the base includes a bracket for coupling the support tube to the base, wherein the bracket is configured to allow pivoting of the support tube in a first direction but prevent pivoting of the support tube in a second, opposite direction.

11. The practice device of claim 1, wherein the post is configured to telescope with respect to the support tube such that the height of the practice balls is adjustable.

12. The practice device of claim 1, wherein the post further comprises a second arm spaced apart from the first arm, and wherein the axle is coupled to both the first arm and the second arm.

13. The practice device of claim 12, wherein the ball rods are configured to rotate between the first arm and the second arm.

14. The practice device of claim 1, wherein the axle is transverse to the support tube longitudinal axis.

15. The practice device of claim 1, wherein each ball rod comprises:

a tether coupled to the respective practice ball; and a sleeve at least partially encompassing the tether.

16. A practice device comprising:

a base;

a support tube extending upward from the base, the support tube having a support tube longitudinal axis;

a post extending from the support tube, the post having a first arm and a second arm spaced apart from the first arm;

an axle coupled to the first and second arms of the post, the axle having a rotation axis, a coupler configured to rotate about the rotation axis;

at least two practice balls;

at least two ball rods, wherein each of the ball rods extends from a first end to a second end, the first end coupled to the coupler and the second end coupled to a respective one of the practice balls; and a brake positioned along the support tube longitudinal axis and disposed below the axle;

wherein upon striking one of the practice balls, the ball rods rotate between the first arm and the second arm of the post about the rotation axis of the axle and as the ball rods rotate the practice balls contact the brake to slow rotation of the ball rods such that the ball rods come to rest with one of the practice balls in contact with the brake and another of the practice balls in a hitting position above the axle.

17. A practice device comprising:

a base;

a support tube extending upward from the base, the support tube having a support tube longitudinal axis;

a post extending from the support tube;

an axle coupled to the post and extending transverse to the longitudinal axis of the support tube, wherein the axle has a rotation axis;

a ball rod extending from a first end to a second end, the first end coupled to a first practice ball and the second end coupled to a second practice ball, the ball rod configured for rotation about the rotation axis; and a brake positioned along the support tube longitudinal axis and disposed below the axle;

wherein, when the ball rod rotates about the rotation axis of the axle, the first practice ball and the second practice ball contact the brake to slow rotation of the ball rod such that the ball rod comes to rest with one of the first and second practice balls in contact with the brake and the other of the first and second practice balls in a hitting position above the axle.

18. The practice device of claim 17, wherein the ball rod comprises:

a tether coupled to the first practice ball; and a sleeve at least partially encompassing the tether.

19. The practice device of claim 17, wherein the brake comprises:

a first brake; and a second brake;

wherein the first brake and the second brake are configured to retain one of the first practice ball and the second practice ball when the ball rod is at rest so as to present the other one of the first and second practice balls in a user's strike zone.

* * * * *